United States Patent [19]

Beaudet et al.

[11] Patent Number: 4,496,236

[45] **Date of Patent: * Jan. 29, 1985**

[54] ANODIZED ELECTROSTATIC IMAGING SURFACE

[75] Inventors: Leo A. Beaudet, Milford; Donald J. Lennon, Acton, both of Mass.

[73] Assignee: Dennison Manufacturing Company, Framingham, Mass.

[ * ] Notice: The portion of the term of this patent subsequent to Nov. 1, 2000 has been disclaimed.

[21] Appl. No.: 529,195

[22] Filed: Sep. 6, 1983

Related U.S. Application Data

[63] Continuation of Ser. No. 346,349, Feb. 5, 1982, Pat. No. 4,413,049, which is a continuation-in-part of Ser. No. 164,482, Jun. 30, 1980, , which is a continuation-in-part of Ser. No. 155,354, Jun. 2, 1980.

[51] Int. Cl.[3] ..... G03G 15/22

[52] U.S. Cl. ..... 355/3 DR; 118/653; 118/661

[58] Field of Search ..... 355/3 DR, 3 FU, 3 TR; 118/653, 661, 60; 430/60, 65, 126, 131

[56] References Cited

U.S. PATENT DOCUMENTS

| | | | |
|---|---|---|---|
| 1,978,112 | 10/1934 | Malby | 148/6.11 |
| 1,996,392 | 4/1935 | Torrence et al. | 428/457 |
| 3,510,411 | 5/1970 | Kramer | 204/38 R |
| 3,615,405 | 10/1971 | Shebanow | 430/60 |
| 3,662,395 | 5/1972 | Doi | 346/74 ES |
| 3,715,211 | 2/1973 | Quaintance | 430/15 |
| 3,782,997 | 1/1974 | Daly | 427/57 |
| 3,851,965 | 12/1974 | Furuichi et al. | 355/15 |
| 3,966,316 | 6/1976 | Pfeifer et al. | 355/3 R |
| 4,130,466 | 12/1978 | Kramer | 204/38 A |

*Primary Examiner*—G. L. Kaplan
*Assistant Examiner*—William T. Leader
*Attorney, Agent, or Firm*—Arthur B. Moore; George E. Kersey; Barry D. Josephs

[57] ABSTRACT

Dielectric sealing of porous anodized aluminum, in which moisture in the pores of the coating formed by hardcoat anodizing is removed, and the porous anodized surface then impregnated with a water insoluble metallic salt. The impregnant material is a compound of a Group II or III metal with a long chain fatty acid containing between 8 and 32 carbon atoms, saturated or unsaturated. The impregnant material may be applied as a hot melt or in solution; in the former case, any excess material is removed from the surface. The resulting product has excellent resistivity and dielectric properties, and maintains these properties at elevated humidities. As a final step the surface may be polished to provide favorable toner release characteristics during pressure transfer.

17 Claims, 1 Drawing Figure

ANODIZED ELECTROSTATIC IMAGING SURFACE

This application is a continuation of Ser. No. 346,349 filed Feb. 5, 1982, now U.S. Pat. No. 4,413,049, which is a continuation-in-part of Ser. No. 164,482, filed June 30, 1980, which is a continuation-in-part of Ser. No. 155,354 filed June 2, 1980.

BACKGROUND OF THE INVENTION

The present invention relates to the sealing of anodized aluminum and aluminum alloy structures, and more particularly to the sealing of such structures to achieve enhanced resistivity and dielectric properties.

Hardcoat anodization of aluminum and aluminum alloys is an electrolytic process which is used to produce thick oxide coatings with substantial hardness. Such coatings are to be distinguished from natural films of oxide which are normally present on aluminum surfaces and from thin, electrolytically formed barrier coatings.

The anodization of aluminum to form thick dielectric coatings takes place in an electrolytic bath containing an oxide, such as sulfuric or oxalic acid in which aluminum oxide is slightly soluble. The production techniques, properties, and applications of these aluminum coatings are described in detail in *The Surface Treatment and Finishing of Aluminum and Its Alloys* by S. Wernick and R. Pinner, fourth edition, 1972, published by Robert Draper Ltd., Peddington, England (chapter IX page 563). Such coatings are extremely hard and mechanically superior to uncoated aluminum. However, the coatings contain pores in the form of fine tubes with a porosity on the order of $10^{10}$ to $10^{12}$ pores per square inch. Typical porosities range from 10 to 30 percent by volume. These pores extend through the coating to a very thin barrier layer of aluminum oxide, typically 300 to 800 Angstroms.

For improved mechanical properties as well as to prevent staining, it is customary practice to seal the pores. One standard sealing technique involves partially hydrating the oxide through immersion in boiling water, usually containing certain nickel salts, which form an expanded boehmite structure at the mouths of the pores. Oxide sealing in this manner will not support an electrostatic charge due to the ionic conductivity of moisture trapped in the pores.

Another method of sealing an anodized aluminum member is disclosed by Quaintance in U.S. Pat. No. 3,715,211. This is a method of cold sealing by the photopolymerization of an organic liquid applied to the anodized surface.

U.S. Pat. No. 3,615,405 discloses a method of fabricating an electrophotographic oxide surface by means of impregnating the porous oxide surface of an aluminum article with an "imaging material." The process creates a member with direct contact between the imaging material and the conductive substrate over which the porous oxide layer is formed. This patent does not disclose a step of dehydrating the oxide pores prior to impregnation with an imaging material (the article is placed in a vacuum oven only after coating with an impregnant material). As such, there is a likelihood of trapped moisture, which would be deleterious to the dielectric properties of the impregnated anodic layer. In order to provide discharge in radiation struck areas, U.S. Pat. No. 3,615,405 requires contact of the "electrographic imaging material" with the conducting substrate. In the present invention, the sealing material contacts an insulating barrier layer.

These foregoing references cannot be used for the processing of an aluminum cylinder for use in electrostatic imaging with pressure fusing and transfer as herein disclosed. In such a system, an electrostatic charge is placed on the insulating surface of the cylinder. This image is then toned as disclosed, for example, in U.S. Pat. No. 3,662,395, and the toned image transferred to plain paper. Table 2 of that patent indicates that a porous aluminum oxide surface sealed with teflon is not satisfactory for electrostatic imaging due to the low breakdown voltage and low pore insulation resistance of the aluminum oxide surface. The organic resin sealant fails to achieve the necessary high abrasion resistance and coating hardness.

A drum coated with an insulating film capable of supporting an electrostatic charge is disclosed in U.S. Pat. No. 3,907,560. The dielectric surface is a barrier layer aluminum oxide film since it is stated that the porous anodized aluminum oxide layer functions as a conductor rather than a dielectric. Although a barrier layer anodized aluminum film is a good insulator, being non-porous, the maximum thickness of barrier layer films is restricted to the region of at most $\frac{1}{2}$ to 1 microns. At this thickness, the maximum voltage the layer will support is limited and the surface is not hard in a conventional sense since any localized strains are transmitted through the thin film with subsequent deformation of the aluminum substrate.

The limitations of the thin barrier film are overcome in U.S. Pat. Nos. 3,937,571 and 3,940,270 by the use of a duplex anodized aluminum coating. The coating is prepared by electrolytically oxidizing an aluminum surface and thereafter continuing the electrolytic oxidization under conditions which produce a barrier aluminum oxide layer. Not only does this increase the complexity of fabricating the anodized layer, but the limiting thickness is approximately 20 microns and the surface potential to which the oxide layer may be charged is a maximum of 620 volts.

U.S. Pat. No. 1,978,112 discloses a technique for forming a lubricant surface layer on aluminum articles for example to prevent seizing of adjacent aluminum machine parts. The lubricant material is a metal stearate such as zinc stearate which is applied by immersing the article in a molten bath. A preferred embodiment of this technique entails an initial anchoring step to provide enhanced adhesion of the stearate. This patent is directed to providing a surface layer of stearate, and is inconsistent with the goals of providing a smooth, hard dielectric surface. In fact, the skilled artisan following the teachings of U.S. Pat. No. 1,978,112 would not produce a surface having favorable charge acceptance properties, even if subsequent steps were taken to remove the surface stearate, due to inadequate impregnation of the pores.

U.S. Pat. No. 3,664,300 discloses electrostatic imaging apparatus incorporating a photoconductive or dielectric imaging cylinder on which a latent electrostatic image is formed, toned, and transferred using an electrostatic assist. The apparatus includes a post-transfer station in which a solid hydrophobic metal salt of a fatty acid is applied to the surface via a fibrous applicator. This treatment allegedly reduces surface wear, while providing enhanced electrostatic toner transfer. However, the technique is not directed to achieving increased charge acceptance, but rather is an ongoing treatment which will have limited effect in this regard. Furthermore, the technique is inconsistent with the requirements of essentially complete pressure toner transfer.

Commonly assigned U.S. patent application Ser. No. 072,524 filed 9/4/79, which is a continuation-in-part of application Ser. No. 822,865, filed 8/8/77 now abandoned, discloses a method for forming a dielectric surface layer involving the preliminary dehydration of an anodized aluminum member followed by impregnation of surface apertures of the dehydrated member with an organic dielectric material. The preliminary dehydration may be accomplished by heating the anodized member in a vacuum or in air, or alternatively by storing it in a desiccant dry box. This application discloses a class of impregnant materials broadly described as organic resins. The method disclosed therein has been found effective to fabricate a dielectric surface with improved resistivity, dielectric properties, and toner release properties. It has been observed, however, that the dielectric properties are deleteriously affected by elevated humidities. Because these materials are usually applied at room temperature, special measures must be taken to control the environment during impregnation to minimize the risk of dehydration. Furthermore, it can be difficult to remedy the problem of an initially uneven application of the impregnant material.

Accordingly, it is a primary object of this invention to provide desired dielectric properties in the treatment of members of porous anodized aluminum and aluminum-based alloys. A related object is to improve the dielectric strength and increase the resistivity of such members. Another related object is the achievement of thick dielectric surface layers with a high voltage acceptance and low charge decay rates.

A further object of the invention is the achievement of a treated aluminum surface that will yield essentially total pressure transfer of a toned electrostatic image to plain paper and other substrates.

Yet another object of the invention is the achievement of a surface which maintains the above properties at elevated humidities.

Still another object of the invention is that the fabrication technique be easily implementable. As a related object, the technique should allow simple remedial steps to meet the above criteria where the initial fabrication is unsuccessful.

SUMMARY OF THE INVENTION

In accomplishing the foregoing and related objects the invention provides for the preliminary dehydration of an anodized aluminum member followed by impregnation of surface apertures of the dehydrated member with a metal salt of a fatty acid. After completion of the impregnating stage, any excess impregnant is removed from the member's surface. In the preferred embodiment, the surface is then polished to a better than 20 microinch finish.

This process results in a hard, abrasion resistant member having a dielectric surface layer. Such a member is especially suited to an electrostatic imaging process wherein a latent electrostatic image formed on the dielectric surface layer is toned, and the toned image is transferred to an image receptor solely by means of pressure exerted at the site of transfer.

In accordance with one aspect of the invention, the dehydrated member is impregnated with a material consisting essentially of a compound of a Group II or Group III metal with a long chain fatty acid. In the preferred embodiment, the impregnant material consists essentially of a compound of a Group II metal with a fatty acid containing between 8 and 32 carbon atoms, saturated or unsaturated.

In accordance with another aspect of the invention the dehydration takes place by heating the anodized member in a vacuum or in air. Heating desirably takes place at a temperature in the range from about 80° C. to about 300° C., with the preferred temperature being about 150° C. The period of time required to heat the anodized member from room temperature to the impregnating temperature will generally be sufficient to accomplish the preliminary dehydration. In an optional embodiment, the member is maintained in a moisture-free environment during any period between anodization and dehydration.

In accordance with the preferred embodiment of the invention, impregnant material is applied to the anodized member while the latter is heated. In one version, the impregnant material is applied in solid form to the surface of the heated member, as by dusting, and the material is then allowed to melt and spread over the surface. In an alternative version, the material is premelted and coated over the heated oxide surface. After the impregnant material thoroughly covers the heated surface, the member is maintained at the elevated temperature for a period, then allowed to cool to room temperature. The pores in the member's surface are sealed by the impregnant in a substantially moisture-free condition. This results in a thick, hard surface with a high potential acceptance and a resistivity in excess of $10^{12}$ ohm-centimeters.

In accordance with an alternative embodiment of the invention, the impregnant material is dissolved and applied in solution to the anodized member. In the preferred version of this embodiment, the member is then heated to a temperature above the melting point of the impregnant material. In accordance with one aspect of this embodiment, suitable solvents include benzene, toluene, and similar materials. In accordance with another aspect of this embodiment, impregnant substances which are suitable for this purpose include the compounds of Group III metals with fatty acids, as well as compounds of Group II metals with fatty acids containing around 32 carbon atoms. In accordance with a further aspect of this embodiment, the member should be maintained in a substantially moisture-free state during impregnation.

In accordance with yet another aspect of the invention, subsequent to impregnation of the oxide surface layer any excess impregnant material is removed from the surface, so that the material remains only in the pores. In the preferred embodiment of the invention, a final step involves polishing the member's surface to a better than 20 microinch finish.

In accordance with still another aspect of the invention, one may remedy undesirable characteristics (as for example an uneven or insufficient level of impregnant) resulting from a poor initial application of the impregnant material. These may be remedied at any time subsequent to impregnation simply by reheating the aluminum member.

In the preferred embodiment of the invention, the treated aluminum member takes the form of an aluminum cylinder for use in electrostatic imaging. The anodized and impregnated surface of the cylinder provides a dielectric surface layer, while the core of the cylinder provides a conducting substrate. The cylinder's surface is characterized by a high potential acceptance and a resistivity in excess of $10^{12}$ ohm-centimeters. The surface is hard and resistant to abrasion. A latent electrostatic image formed on the dielectric surface may be toned and transferred to a further member; the polished surface yields an essentially complete pressure transfer of hydrophobic toner. The hard dielectric surfaces which are characteristic of the invention permit the use of high transfer pressures which effect simultaneous fusing of the toner image to an image receptor medium. The image receptor may comprise a sheet, and the transferring step may comprise passing the image receptor sheet between an image cylinder and a transfer cylinder in rolling pressure contact.

BRIEF DESCRIPTION OF THE DRAWING

Other aspects of the invention will become apparent after considering the drawing and detailed description below.

DETAILED DESCRIPTION

Figure 1:
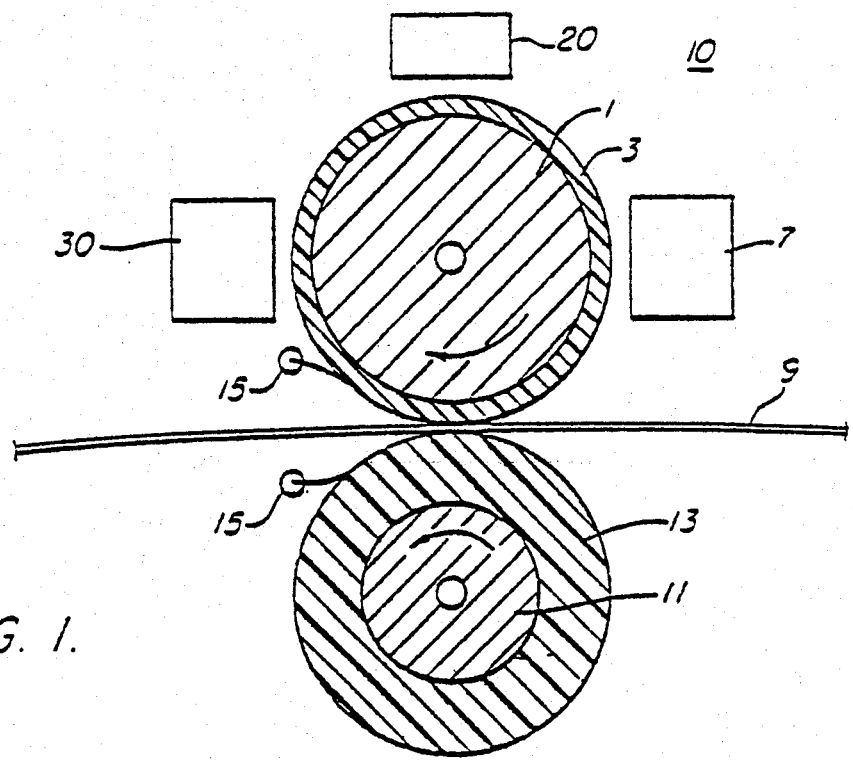
FIG. 1 is a schematic view of an electrostatic printer incorporating an image cylinder fabricated in accordance with the method of the invention.

The method of Ser. No. 072,524, as to which the present invention represents an improvement, comprises a series of steps for fabricating and treating anodized aluminum members. This method results in members particularly suited to electrostatic imaging. The treated member, advantageously in the form of an imaging cylinder having a dielectric surface and a conducting core, is adapted to receive an electrostatic latent image, to carry the image with minimal charge decay to a toning station, and to impart the toned image to a further member preferably by pressure transfer. A number of properties of particular concern in this utilization are the hardness and abrasion resistance of the surface; the potential acceptance and dielectric strength of the dielectric layer; the resistivity of the dielectric layer; and the release properties of the surface with respect to electrostatic toner.

In order to provide a member of suitable configuration, an initial step entails the fabrication of an aluminum member of desired form. In the preferred embodiment, the member consists of a cylinder of aluminum or aluminum alloy, machined to a desired length and outside diameter. The surface is smoothed preparatory to the second step of hardcoat anodization.

In the second processing stage, the machined aluminum member is hardcoat anodized preferably according to the teachings of Wernick and Pinner; see *The Surface Treatment and Finishing of Aluminum and its Alloys* by S. Wernick and R. Pinner, fourth edition, 1972, published by Robert Draper Ltd., Paddington, England. The anodization is carried out to a desired surface thickness, typically one to two mils. This results in a relatively thick porous surface layer of aluminum oxide characterized by the presence of a barrier layer isolating the porous oxide from the conductive substrate. Following anodization, the member's surface is thoroughly rinsed in de-ionized water in order to remove all anodizing bath and other residual substances from the surface and the pores. The rinsed surface may be wiped dry to minimize surface moisture.

After anodizing the member, and prior to impregnating of the pores with a sealing material, the method of the invention requires a thorough dehydration of the porous surface layer. For best results, the dehydration is accomplished immediately after anodization. If there is a long delay between these two steps, however, it is advisable to maintain the member in a moisture-free environment in order to avoid a reaction with ambient moisture which leads to the formation of boehmite [$AlO(OH)_2$] at pore mouths, effectively partially sealing the porous oxides so that subsequent impregnation is incomplete and dielectric properties degraded. This partial sealing can occur at room temperature in normal ambient humidity in a period of several days.

Removal of absorbed water from the oxide layer of an anodized aluminum structure may be realized by using either heat, vacuum, or storage of the article in a desiccator. The dehydration step requires thorough removal of water from the pores. Although all three techniques are effective, best results are realized by heating in a vacuum, for example in a vacuum oven. A preliminary step of dehydrating the member in a vacuum oven is especially preferred where the member has been stored in a moist environment for a period after anodization. Heating of the member in air, as compared with vacuum heating, results in only a slightly lower level of charge acceptance. It is preferable that any thermal treatment of the oxide prior to impregnation be carried out at a temperature in the range from about 80° C. to about 300° C., with the preferred temperature being about 150° C. Where precautions have been taken after anodizing to minimize the retention and accumulation of moisture, the dehydration step may be accomplished in conjunction with the impregnation step, as explained below.

After removal of absorbed water from the oxide coating it is sealed with an impregnant material. In the present invention, the impregnant material consists essentially of a compound of a Group II or III metal with a long chain fatty acid. It has been discovered that a particularly advantageous class of materials includes the compounds of Group II metals with fatty acids containing between 8 and 32 carbon atoms saturated or unsaturated. The impregnant materials may comprise either a single compound or a mixture of compounds. Due to the water repellant nature of these alkaline earth derivatives, the product of the invention has superior dielectric properties at high humidities.

In order to avoid introduction of moisture into the dehydrated porous surface layer, the member should be maintained in a substantially moisture-free state during impregnation. This will occur as a natural consequence of the preferred method of applying the impregnant materials of the invention. At room temperature these materials take the form of powders, crystalline solids, or other solid forms. In the preferred embodiment of the invention, the member is maintained at an elevated temperature (above the melting point of the impregnant material) during the impregnation step in order to melt the material or to avoid solidifying premelted material. These materials have sufficiently low viscosity after melting to readily impregnate the pores of the oxide surface layer. In this embodiment the period of heating the member from room temperature to the impregnating temperature may provide the preliminary dehydration which is required to avoid trapped moisture in the pores, often without a prior separate dehydrating step. This preheating stage may take minutes or hours depending on the mass and volume of the aluminum member. See Examples 1 and 2. In the alternative embodiment of the invention discussed below, in which the impregnant materials are applied in solution to the anodized member, it is advisable to heat the member or take other steps in order to avoid reintroduction of moisture during the impregnation process.

It has generally been found unnecessary to maintain the heated member in a vacuum environment during impregnation, either to avoid absorption of moisture or to assist the impregnation of the pores through capillarity. In the preferred embodiment, the impregnant material may be applied to the oxide surface under moist ambient conditions because the heating of the aluminum member will tend to drive off any absorbed moisture from the oxide surface. Optionally, a vacuum may be employed in order to provide an extra precaution against reintroduction of moisture. This may be contrasted to the fabrication process of Ser. No. 072,524, which requires special measures to protect against reintroduction of moisture during the impregnation stage; similar measures are required in the alternative embodiment in which the impregnant material is dissolved prior to application to the anodized member.

In the preferred embodiment of the invention, the impregnant material is applied to the surface of the aluminum member after heating the member to a temperature above the melting point of the material. In one version of this embodiment, the material is applied to the surface in solid form (as by dusting or blowing it onto the surface), whereupon the material will melt. In an alternative version, the material is premelted and applied to the oxide surface in liquid form (as by brushing the material onto the member or immersing the member in melted material). In either case, the material should then be allowed to spread over the oxide surface layer. This may be done by permitting a flow of the melted material, or by manually spreading the material over the surface using a clean implement. The member should be maintained at this elevated temperature for a period of time sufficient to allow the melted material to completely impregnate the pores of the oxide surface layer. This period will be shorter when using a vacuum to assist impregnation.

In the preferred embodiment, if the member is allowed to cool prior to complete filling of the pores with the impregnant material, the material will tend to solidify leaving undesirable air pockets in the pores. It is a particularly advantageous aspect of this method that this problem may be remedied simply by reheating the aluminum member and allowing a more complete filling of the pores. The member may be reheated for a subsequent impregnation step at any time subsequent to the initial impregnation, as the impregnant material of the invention is not permanently cured.

In an alternative embodiment of the invention, the impregnant material is dissolved prior to application of the oxide surface layer. Materials of the invention susceptible to application in this manner include the compounds of Group III metals with fatty acids, as well as the compounds of Group II metals with some of the longer chain fatty acids (those having around 32 carbon atoms). Solvents which are suitable for this purpose include, for example, benzene and butyl acetate. After the material is dissolved, it may be applied to the member by spraying or brushing it onto the oxide surface layer. The solution is allowed to penetrate the pores. Any excess impregnant is removed by wiping the member's surface. In order to avoid reintroduction of moisture into the dehydrated porous surface layer, the member may be impregnated in a vacuum oven or in air at a temperature in the range from about 40° C. to 55° C. Alternatively, the member may be impregnated in a desiccant dry box. Advantageously, this method would reflect that employed in the prior dehydration step.

It is desirable subsequent to precipitation of the impregnant material in the alternative embodiment to heat the member to a temperature above the melting point of the material. This fuses the material in the pores, and minimizes the occurrence of air pockets which are deleterious to dielectric properties. The member may be reheated as in the preferred embodiment in order to prove a more complete impregnation.

Subsequent to impregnation of the pores, the aluminum is allowed to cool. The member is then treated (as by wiping or scraping) to remove any excess material from the surface, leaving only the material in the pores. In order to provide a surface with good release properties for electrostatic toner, a preferred embodiment of the invention includes a final step of polishing the member's surface to a better than 20 microinch finish, and preferably better than a 10 microinch finish.

FIG. 1 shows schematically the incorporation of an image cylinder of the preferred embodiment of the invention in an electrographic printing system. The printer 10 is formed by two metallic rollers 1 and 11. The upper roller, fabricated by the method described above, includes a dielectric surface layer 3 and a conducting core 1, while the lower roller has a layer of engineering thermoplastic material 13 over a metallic core 11. A latent electrostatic image in the pattern of an imprint that is to be made is provided in the dielectric layer 3 by charging head 20. The latent image is then toned, for example by charged, colored particulate matter, at a station 7, following which the toned image undergoes essentially total pressure transfer with simultaneous room temperature fusing to a receptor sheet 9, to form the desired imprint. No heat or electrostatic aid is utilized in the image transfer. The electrostatic printer of FIG. 1 desirably includes scraper blades 15 and a unit 30 for erasing any latent residual electrostatic image that remains on the dielectric layer 3 before reimaging takes place at the charging head 20.

The dielectric layer 3 advantageously is capable of accepting a latent electrostatic image of relatively high potential. In general, a thicker dielectric layer will possess a higher charge acceptance. As a related matter, the surface layer 3 should have a high dielectric strength. The invention provides a simple and reliable technique for fabricating aluminum oxide layers of a thickness as great as 4 mils and capable of supporting several thousand volts. It is desirable for the dielectric surface layer 3 to have sufficiently high resistivity to support a latent electrostatic image during the period between latent image formation and toning. Consequently, the resistivity of the layer 3 must be in excess of $10^{12}$ ohm-cm. The surface of the layer 3 should be highly resistant to abrasion and relatively smooth, in order to provide for complete transfer of toner to the receptor sheet 9. The dielectric layer 3 additionally should have a high modulus of elasticity so that it is not distorted by high pressures in the transfer nip. Such pressures advantageously are sufficiently high to effect simultaneous transfer and fusing of the toner image. A dielectric cylinder produced in the manner described above satisfies all these requirements.

The advantages of this invention will be further apparent from the following non-limiting examples.

EXAMPLE 1

A series of panels (1.5 inch×1.5 inch×0.067 inch) fabricated of aluminum alloy 7075-T6 were hard-coat anodized in sulphuric acid by the Sanford "Plus" process* to a depth of 1.5 mil. The panels were rinsed with deionized water and wiped free of surface moisture. They were then wrapped in moisture absorbant paper and stored for about one day.

*Sanford Process Corp.; 65 North Avenue, Natick, MA.

The anodized panels were unwrapped and heated to a temperature above the melting point of the material to be applied (see Table I) and maintained at this temperature for one minute prior to application of the impregnant material. The material was dusted onto the heated panel where it melted rapidly and was allowed to flow over the oxide surface layer.

TABLE I

| IMPREGNANT MATERIAL | IMPREGNATING TEMPERATURE (°C.) | CHARGE (Volts/micron) ACCEPTANCE |
|---|---|---|
| Barium Stearate | 300° C. | 22 |
| Zinc Stearate | 150° C. | 34.5 |
| Magnesium Stearate | 150° C. | 25 |
| Zinc Octanoate | 150° C. | 33 |
| Zinc Behemate | 150° C. | 41.5 |
| Zinc Oleate | 150° C. | 7 |
| Zinc Octanoate: Barium Stearate | 300° C. | 19 |

The coated member was maintained at the elevated temperature for another minute, and then allowed to cool to room temperature. This process was repeated with a number of different impregnant materials including in one case a mixture of two different compounds—see Table I.

After cooling, the samples were ground with 240 grit sandpaper and water to a thickness of between 40 and 45 microns. They were then heated on a hot plate at 150° C. for approximately 30 seconds in order to rapidly evaporate the surface moisture, and then allowed to cool.

The plates were placed over a negative ion discharge and charged to a maximum voltage. This voltage was measured by a Monroe Electronics electrostatic voltmeter.

EXAMPLE 2

A hollow aluminum cylinder of extruded 7075-T651 alloy was machined to an outer diameter of 4 inches and 9 inch length, with 0.75 inch wall thickness. The cylinder was machined to a 30 microinch finish, then polished to a 2.25 microinch finish. The cylinder was hardcoat anodized by the Sanford "Plus" process to a thickness between 42 and 52 microns, then rinsed in deionized water and packed in plastic bags.

On the following day, the cylinder was unpacked and placed in a vacuum oven at 30 inches mercury. After half an hour, the oven temperature was set at 150° C., which temperature was achieved in a further forty minutes. The cylinder was maintained at this temperature and pressure for four hours prior to impregnation.

A beaker of zinc stearate was preheated to melt the compound. The heated cylinder was removed from the oven, and coated with the melted zinc stearate using a paint brush. The cylinder was then placed back in the vacuum oven for a few minutes at 150° C., 30 inches mercury. The cylinder was removed from the oven and allowed to cool.

After cooling, the member was polished with successively finer SiC abrasive papers and oil. Finally, the member was lapped to a 4.5 miroinch finish by application of a lapping compound and oil with a cloth lap.

Using the testing method of Example 1, the cylinder's charge acceptance was measured at 980 volts.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. Electrostatic imaging apparatus, comprising:

a dielectric image member, comprising a substrate of a material selected from the group aluminum and aluminum alloys, with a dielectric surface layer having a resistivity of at least $10^{12}$ ohm-centimeters produced by hardcoat anodizing the substrate to form an oxide surface layer, dehydrating the oxide surface layer, impregnating the dehydrated surface layer with a material selected from the group consisting of compounds of Group II or Group III metals with fatty acids, and removing excess material from the member's surface;

means for forming a latent electrostatic image on the dielectric image member;

means for toning the latent electrostatic image; and means for simultaneously transferring and fusing the toned image from the image member to an image receptor.

2. Apparatus as defined in claim 1 wherein the transferring and fusing means comprises a transfer member contacting said dielectric image member under high pressure, with the image receptor fed therebetween.

3. Electrostatic imaging apparatus as defined in claim 2 wherein the image member and transfer member comprise cylinders in rolling contact, and wherein the transfer cylinder has a relatively compliant surface layer.

4. Electrostatic imaging apparatus as defined in claim 1, wherein the dielectric image member has a hard, smooth surface formed by polishing the member to a better than 20 microinch RMS finish.

5. Electrostatic imaging apparatus as defined in claim 1, wherein the oxide surface layer is impregnated while being maintained in a moisture-free state.

6. Electrostatic imaging apparatus as defined in claim 1, further comprising means for erasing any residual electrostatic image after transferring the toned image, preparatory to forming a further latent electrostatic image.

7. Electrostatic imaging apparatus as defined in claim 1, wherein the dielectric surface layer has a thickness of between 0.5 and 4 mils.

8. In a printer of the type used to form a selected image on a receptor medium, the printer having a cylinder including a dielectric surface layer having a resistivity of at least $10^{12}$ ohm-centimeters, means for forming a latent electrostatic image corresponding to the selected image on the surface of the cylinder, means for toning the latent electrostatic image, a compliant roller forming with the cylinder a nip, and means for moving the receptor medium through the nip under pressure to receive the toned image, the improvement in which the cylinder comprises a core selected from the materials aluminum and aluminum alloys, and an outer porous oxide layer formed by hardcoat anodizing impregnated with a material selected from the group consisting of compounds of Group II or Group III metals with fatty acids, said material having been removed from the cylinder's surface.

9. Electrostastic imaging apparatus as defined in claim 8, wherein the cylinder has a hard, smooth surface formed by polishing to a better than 20 microinch RMS finish.

10. Electrostatic imaging apparatus as defined in claim 8, wherein the porous oxide layer is impregnated while being maintained in a moisture-free state.

11. Electrostatic imaging apparatus as defined in claim 8, further comprising means for erasing any residual electrostatic image after transferring the toned image, preparatory to forming a further latent electrostatic image.

12. Electrostatic imaging apparatus as defined in claim 8, wherein the dielectric surface layer has a thickness of between 0.5 and 4 mils.

13. The combination of an image cylinder and a roller for use in transferring a toned image from the image cylinder to a receptor medium fed between the cylinder and roller under pressure, the combination comprising:

a cylinder mounted for rotation about its axis, the cylinder including a core of a material selected from the group aluminum and aluminum alloys, and an outer porous oxide layer formed by hardcoat anodizing impregnated with a material selected from the group consisting of compounds of Group II or Group III metals with fatty acids, said material having been removed from the cylinder's surface; and a compliant roller mounted in rolling contact under high pressure with the image cylinder, wherein the receptor medium is fed between the imaging cylinder and compliant roller to receive the toned image.

14. Electrostatic imaging apparatus as defined in claim 13, wherein the image cylinder has a hard, smooth surface formed by polishing to a better than 20 microinch RMS finish.

15. Electrostatic imaging apparatus as defined in claim 13, wherein the porous oxide layer is impregnated while being maintained in a moisture-free state.

16. Electrostatic imaging apparatus as defined in claim 13, wherein the porous oxide layer has a thickness of between 0.5 and 4 mils.

17. Electrostatic imaging apparatus as defined in claim 13, wherein the cylinder and compliant roller are pressed together to fuse the toned image to the receptor medium simultaneously with transfer.

* * * * *